US009120308B2

(12) United States Patent
Kida

(10) Patent No.: US 9,120,308 B2
(45) Date of Patent: Sep. 1, 2015

(54) CONTROL CIRCUIT AND CONTROL METHOD THEREOF, LIQUID DROPLET EJECTION HEAD AND IMAGE FORMING APPARATUS

(71) Applicant: Hitoshi Kida, Kanagawa (JP)

(72) Inventor: Hitoshi Kida, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/483,250

(22) Filed: Sep. 11, 2014

(65) Prior Publication Data

US 2015/0070421 A1 Mar. 12, 2015

(30) Foreign Application Priority Data

Sep. 12, 2013 (JP) ..... 2013-189063
Sep. 2, 2014 (JP) ..... 2014-177617

(51) Int. Cl.
*B41J 29/38* (2006.01)
*B41J 2/045* (2006.01)

(52) U.S. Cl.
CPC ..... *B41J 2/0455* (2013.01); *B41J 2/04541* (2013.01)

(58) Field of Classification Search
CPC ..... B41J 29/38; B41J 2/04541; B41J 2/0455; B41J 2/04551
USPC ..... 347/9
See application file for complete search history.

(56) References Cited

U.S. PATENT DOCUMENTS 7,950,758 B2 5/2011 Yoshida
8,376,490 B2 2/2013 Watanabe

FOREIGN PATENT DOCUMENTS

JP 2008-001084 1/2008
JP 2011-255636 12/2011
JP 2012-061664 3/2012

*Primary Examiner* — Alessandro Amari
*Assistant Examiner* — Michael Konczal
(74) *Attorney, Agent, or Firm* — Cooper & Dunham LLP

(57) ABSTRACT

A control circuit is disposed in which an analog switch is built, an ON/OFF-timing of the analog switch can be controlled, and mask-patterns can be set, which mask-patterns are used for switching ON/OFF the analog switch can be selected by analog-switch-selection data, and a number of the mask-patterns which can be set can be selected. The circuit includes mask-pattern-setting units for setting one of the mask-patterns by one of switching control signals; and a selection unit for selecting a mode from modes including a first mode in which the number of mask-patterns is smaller and a second mode in which the number of mask-patterns is larger. When the first mode is selected by the selection unit, to one mask-pattern-setting unit which is not selected by the analog-switch-selection data, the same switching control signal that is supplied to another mask-pattern-setting unit which is selected by the analog-switch-selection data is supplied.

8 Claims, 12 Drawing Sheets

| s | $i_0$ | $i_1$ | z |
|---|---|---|---|
| L | L | L | L |
| L | L | H | L |
| L | H | L | H |
| L | H | H | H |
| H | L | L | L |
| H | L | H | H |
| H | H | L | L |
| H | H | H | H |

| s | i | z0 | z1 |
|---|---|---|---|
| L | L | L | L |
| L | H | H | L |
| H | L | L | L |
| H | H | L | H |

CONTROL CIRCUIT AND CONTROL METHOD THEREOF, LIQUID DROPLET EJECTION HEAD AND IMAGE FORMING APPARATUS

BACKGROUND OF THE INVENTION

1. Field of the Invention

The disclosures herein generally relate to a control circuit and a control method thereof, a liquid droplet ejection head and an image forming apparatus.

2. Description of the Related Art

Conventionally, in the technical field of inkjet heads, an inkjet head is known which inkjet head has mounted a driver IC (control circuit) performing selection of electro-mechanical conversion elements for supplying a drive voltage wave form.

This driver IC includes, for example, analog switches connected to respective electro-mechanical conversion elements, selects a prescribed electro-mechanical conversion element by causing the analog switches to be ON or OFF, and causes liquid droplets to be ejected by applying the drive voltage wave form only to the selected electro-mechanical conversion element. In order to cause the analog switches to be ON or OFF, for example, a method can be used in which shift registers are built in the driver IC and analog switch selection data are set to the shift registers by externally inputting a data signal to the shift registers.

As a specific control method of the driver IC, a method is known in which the data signal input to the shift registers includes two bits and a print job is performed by four gradations: no liquid droplet ejection, a small droplet, a medium droplet and a large-size droplet (e.g., refer to Patent Document 1). Also, another method is known in which the data signal input to the shift registers includes three bits, a gradation control is available up to eight gradations and a print job is performed by five gradations: no liquid droplet ejection (without even a subtle drive), a small droplet, a medium droplet, a large droplet and a subtle drive (e.g., refer to Patent Document 2).

In the latter method (controlling up to eight gradations), although it is possible to prevent an ejection failure due to dried or viscosity-increased ink on the nozzle surface by performing the subtle drive, there are problems such as increased number of data signal lines for controlling five gradations, a more expensive controller and an increased cost for wiring parts. Therefore, although it may be possible to implement a function to control five gradations in expensive higher-performance models, it may be difficult to implement the function in inexpensive lower-performance models.

On the other hand, there is a requirement for using a common driver IC for both higher-performance models and lower-performance models because providing a dedicated driver IC for the higher-performance models and another dedicated driver IC for the lower-performance models leads to problems such as: the cost cannot be lowered because of decreased production numbers; and the cost will be increased because of increased numbers of management stock models. Therefore, there is a method in which a mode setting terminal is included in a driver IC and the number of gradations, such as four gradations or eight gradations, can be switched by switching H/L of a mode signal for the mode terminal.

In this case, two bits of the data signal are used for setting the analog switch selection data for the four gradations and three bits of the data signal are used for the eight gradations so that the data are read into two shift registers for the four gradations while the data are read into three shift registers for the eight gradations. Therefore, in the driver IC which is capable of switching between the four gradations and the eight gradations, when it is used for the four gradations, the third bit of the analog switch selection data signal is not provided and the third shift register is not used (functionally disabled).

For the third register which is not used for the four gradations, data is not set. As a result, the data is undefined (it can be H (1) or L (0)), or the data is not properly set by the two bits of the data signal alone. If a drive voltage is applied to an electro-mechanical conversion element when the data is not correctly set and the analog switch corresponding to the undefined data is caused to be ON, then a liquid droplet is unintentionally ejected.

In order to avoid the above problem, it is possible to design in such a way that before the drive voltage wave form is applied to the inkjet head after the power ON, inside the driver IC, the data of all L or all H is forcibly set to the third shift register which is not used for the four gradations. In other words, it is possible to design in such a way that clocks or latches are used to perform an initial operation for fixing the data of the third shift register to all L or all H.

However, there is a problem in that it is complicated to provide the initial operation. Although, in order to avoid such a problem, there is a method in which the same number of data signals and the same number of switching control signals are used when the lower number of gradations is selected as when the higher number of gradations is selected, there is a problem of increased cost.

[Patent Document 1] Japanese Patent Application Publication No. 2008-001084

[Patent Document 2] Japanese Patent Application Publication No. 2012-061664

SUMMARY OF THE INVENTION

It is a general object of at least one embodiment of the present invention to provide a control circuit or the like in which the number of gradations can be switched and the initial operation is not necessary even when the mode of lower number of gradations is selected, that substantially obviates one or more problems caused by the limitations and disadvantages of the related art.

The control circuit is configured to include a built-in analog switch, can control an ON/OFF timing of the analog switch, can set a plurality of mask patterns, can select which one of the mask patterns is used for switching ON/OFF the analog switch by analog switch selection data, and can select a number of the mask patterns which can be set. The control circuit includes a plurality of mask pattern setting units configured to set the mask pattern by a switching control signal; and a selection unit configured to select a mode from a plurality of modes including a first mode in which the number of mask patterns is smaller and a second mode in which the number of mask patterns is larger. When the first mode is selected by the selection unit, to one of the mask pattern setting units which is not selected by the analog switch selection data, the same switching control signal that is supplied to another one of the mask pattern setting units which is selected by the analog switch selection data is supplied.

According to the embodiments of present invention, a control circuit or the like in which the number of gradations can be switched and the initial operation is not necessary even when the mode of a lower number of gradations is selected can be provided.

BRIEF DESCRIPTION OF THE DRAWINGS

Other objects and further features of embodiments will become apparent from the following detailed description when read in conjunction with the accompanying drawings, in which.

DESCRIPTION OF THE PREFERRED EMBODIMENTS

In the following, embodiments of the present invention will be described with reference to the accompanying drawings. In each of the drawings, the same numeral is assigned to the same configuration part and the duplicated description may be omitted.

The First Embodiment

Figure 1:
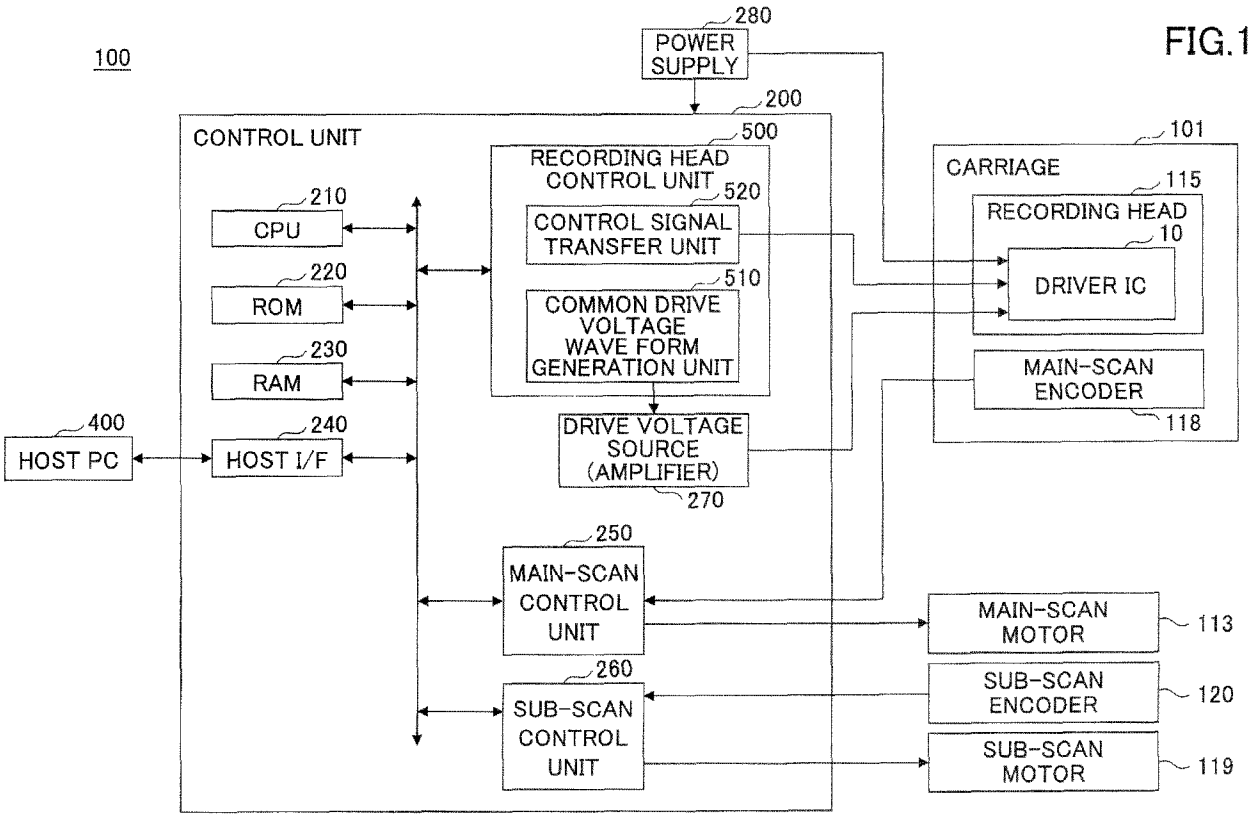
FIG. 1 is a drawing illustrating a functional configuration of an image forming apparatus according to the first embodiment.

FIG. 1 is a drawing illustrating a functional configuration of an image forming apparatus 100 according to the first embodiment. The image forming apparatus 100 according to the first embodiment includes a control unit 200 disposed in the apparatus body. The control unit 200 controls the image forming apparatus 100 and transfers data to a driver IC 10 which will be described later. It should be noted that the power is provided to the control unit 200 and the driver IC 10 from a power supply 280.

The image forming apparatus 100 is connected to a host computer 400 via a network or the like. Upon receiving image data created by the host computer 400, the control unit 200 transfers the image data and the data for forming an image corresponding to the image data to the driver IC 10. The driver 10 drives a recording head 115 according to the transferred data.

The control unit 200 includes a CPU 210, a ROM 220, a RAM 230, a host I/F 240, main-scan control unit 250, sub-scan control unit 260, a drive voltage source 270 and a recording head control unit 500.

The CPU 210 controls the control unit 200 as a whole. Also, the CPU 210 reads a program stored in the ROM 220 and executes the program. The ROM 220 stores drive signals which are signals for driving firmware used for hardware control and the recording head 115. The drive signals are a common drive voltage wave form Vcom which will be described later.

The RAM 230 stores the image data received from the host computer 400. The host I/F 240 sends/receives data to/from the host computer 400. The main scan control unit 250 controls a main scan motor 113 according to an output of a main-scan encoder 118. The sub-scan control unit 260 controls a sub-scan motor 119 according to an output of a sub-scan encoder 120. The drive voltage source 270 supplies the voltage for driving the recording head 115 to the driver IC 10.

The recording head control unit 500, in conjunction with location information of a carriage 101 obtained from the main-scan encoder 118, transfers the image data stored in the RAM 230 and the common drive voltage wave form Vcom to the driver IC 10. Also, the recording head control unit 500 transfers the control data, which will be described later, to the driver IC 10. It should be noted that the carriage 101 includes the driver ICs 10 which drive respective recording heads 115 which are provided for respective colors.

Figure 2:
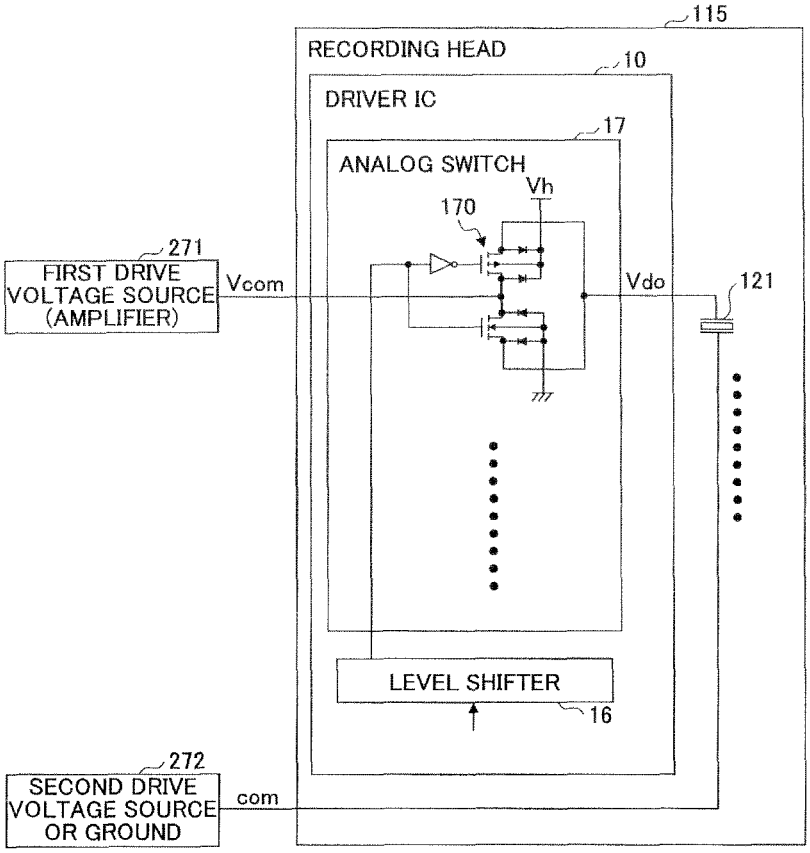
FIG. 2 is a drawing (No. 1) illustrating a driver IC according to the first embodiment.
Figure 3:
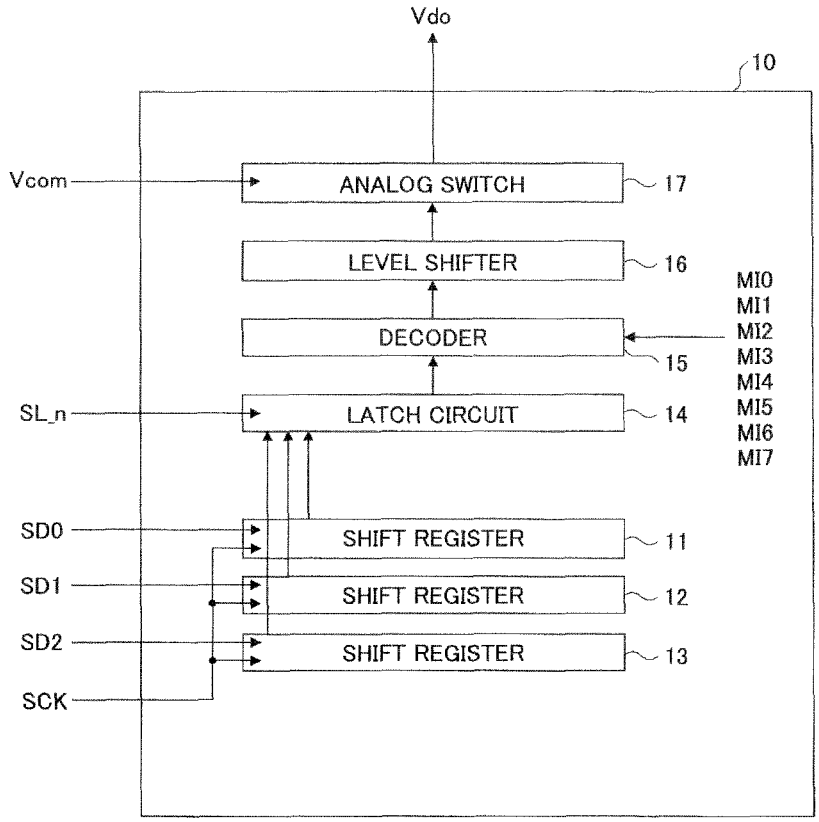
FIG. 3 is a drawing (No. 2) illustrating a driver IC according to the first embodiment.

In the following, referring to FIG. 2 and FIG. 3 in addition to FIG. 1, the driver IC 10 according to the present embodiment will be described in detail. FIG. 2 and FIG. 3 are drawings illustrating the driver IC 10 according to the first embodiment. In FIG. 2 and FIG. 3, of all the driver ICs which are included in the carriage 101 and provided for respective colors, a driver IC 10 is shown which drives one of the recording heads 115 for a certain color. In the present embodiment, other driver ICs 10 included in the carriage 101 may have the same configuration as this driver IC 10.

The driver IC 10 includes, shift registers 11 through 13, a latch circuit 14, a decoder 15, a level shifter 16 and an analog switch 17. The driver IC 10 is a typical example of a control circuit according to the present embodiment.

The driver IC 10 is an integrated circuit for driving a plurality of electro-mechanical conversion elements 121 which are included in the recording head 115 (inkjet head) which is mounted in the image forming apparatus 100. The driver IC 10 is electrically connected to a control signal transfer unit 520 of the recording head control unit 500. The driver IC 10 drives the plurality of electro-mechanical conversion elements 121 to eject ink droplets based on data transferred from the control signal transfer unit 520. It should be noted that the electro-mechanical conversion elements 121 are typical examples of an ejection pressure generation unit according to the present embodiment.

A common drive voltage wave form generation unit 510 of the recording head control unit 500 generates a common drive voltage wave form Vcom including a plurality of different drive signals. The common drive voltage wave form Vcom generated by the common drive voltage wave form generation unit 510 is provided to each of analog switch elements 170 which are included in an analog switch 17 in the driver IC 10 via a first drive voltage source 271 (amplifier) of the drive voltage source 270. An output Vdo of each of the analog switch elements 170 is connected to one end of the electro-mechanical conversion element 121 and the other end of the electro-mechanical conversion element 121 is connected to a second drive voltage source 272 of the drive voltage source 270 or grounded.

The driver IC 10 includes an input unit for encoded serial data SD0 through SD2 in which a drive pattern (indicating which electro-mechanical conversion element 121 should be driven based on which mask pattern) of the plurality of electro-mechanical conversion elements 121 which are driven by the driver IC 10 is encoded. It should be noted that the data SD0 through SD2 are three-bit serial data and it is possible to handle an operation of eight gradations by using the data SD0 through SD2.

It should be noted that the mask pattern is a pattern which indicates which drive signal of the common drive voltage wave form Vcom, which includes a plurality of drive signals, should be masked. The pattern indicates the timing control of ON or OFF of the analog switch elements 170. The drive signals which are masked may be a part or all of the common drive voltage wave form Vcom. The maximum number of mask pattern types for the four gradations is four and the maximum number of mask pattern types for the eight gradations is eight.

The control signal transfer unit 520 transfers data SD0, SD1 and SD2, a clock signal SCK, a latch signal SL_n or the like to the driver IC 10. The clock signal SCK is a clock signal for taking the timing of transferring data SD0 through SD2. The data SD0 through SD2 are transferred to the driver IC 10 from the control signal transfer unit 520, synchronizing with the clock signal SCK. The latch signal SL_n is a signal which indicates the latching of the data SD0 through SD2.

The shift register 11 takes the data SD0 synchronizing with the clock signal SCK sent from the control signal transfer unit 520. The shift register 12 takes the data SD1 synchronizing with the clock signal SCK. The shift register 13 takes the data SD2 synchronizing with the clock signal SCK. In other words, the values of H or L of the data SD0 at the timing of the rising pulse of the clock signal SCK are set in the shift register 11, the values of H or L of the data SD1 are set in the shift register 12, and the values of H or L of the data SD2 are set in the shift register 13, respectively.

The latch circuit 14 latches the data SD0 through SD2 in accordance with the latch signal SL_n. In other words, based on the rising pulse of the latch signal SL_n sent from the control signal transfer unit 520, the values set in the shift registers 11 through 13 are latched. The latched values and switching control signals MI0 through MI7 are input to the decoder 15. The decoder 15 decodes the data SD0 through SD2 and outputs the specified one of the switching control signals MI0 through MI7 to the corresponding one of the analog switches 17.

Here, the switching control signals MI0 through MI7 are signals generated corresponding to mask patterns and are two-bit signals indicating open/close of each of the analog switch elements 170 of the analog switch 17 for each of ink droplets. For example, when, of switching control signals MI0 through MI7, a signal corresponding to a predetermined drive signal of the common drive voltage wave form Vcom is H level, the drive signal which should be provided for the corresponding electro-mechanical conversion element 121 is masked. When, of switching control signals MI0 through MI7, a signal corresponding to a predetermined drive signal of the common drive voltage wave form Vcom is L level, the drive signal is provided for the corresponding electro-mechanical conversion element 121 and a liquid droplet is ejected from the nozzle.

In this way, the decoder 15 functions as a mask pattern setting unit for setting a mask pattern (gradation) used for selecting the drive voltage wave form which should be applied to each of the analog switch elements 170 of the analog switch 17 based on the plurality of the switching control signals MI0 through MI7. It should be noted that the mask pattern setting units are provided for respective switching control signals MI0 through MI. In the eight gradation mode, the mask pattern setting units corresponding to switching control signals MI0 through MI7 are all needed. On the other hand, in the four gradation mode, the mask pattern setting units corresponding to only the switching control signals MI0 through MI3 are needed and the mask pattern setting units corresponding to the switching control signals MI4 through MI7 are not needed. In other words, in the four gradation mode, the mask pattern setting units corresponding to the switching control signals MI4 through MI7 are not selected.

The level shifter 16 transforms the level of logic level voltage signal of the decoder 15 to a level at which the analog switch 17 is operable. The analog switch 17 is caused to be ON/OFF by the output of the decoder 15 given via the level shifter 16. The analog switch 17 includes the same number of analog switch elements 170 as and corresponding to the number of electro-mechanical conversion elements 121 which are driven by the driver ICs 10. The common drive voltage wave form Vcom can be input to the input side of each of the analog switch elements 170 of the analog switch 17. Individual electrodes of the electro-mechanical conversion elements 121 can be connected to the output side of the corresponding analog switch elements 170 of the analog switch 17. In the analog switch 17, the common drive voltage wave form Vcom is output from the output Vdo of the analog switch element 170 which is ON. The output Vdo of the analog switch element 170 which is OFF will be of high impedance.

In this way, by controlling the analog switch 17 in accordance with the decoded result of the data SD0 through SD2 decoded by the decoder 15, a predetermined drive signal is selected from the drive signals included in the common drive voltage wave form Vcom and applied to an electro-mechanical conversion element 121. In an image forming apparatus which is equipped with the driver IC 10, the electro-mechanical conversion elements 121 included in the recording head 115 are driven by the above configuration and an image corresponding to the image data is formed.

Figure 4:
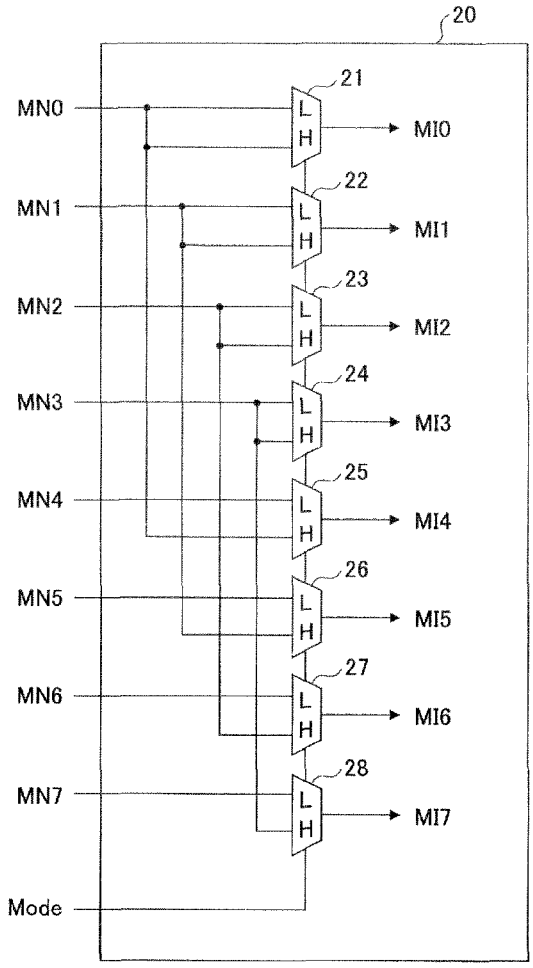
FIG. 4 is a drawing illustrating an example of a switching control signal generation unit according to the first embodiment.

FIG. 4 is a drawing illustrating an example of a switching control signal generation unit according to the first embodiment. Referring to FIG. 4, a switching control signal generation unit 20 includes a function in which the switching control signals MI0 through MI7 corresponding to a mask pattern are generated based on signals MN0 through MN7 and a Mode signal which are input to the driver IC 10 from the outside. The switching control signal generation unit 20 can be built in the driver IC 10.

It should be noted that the Mode signal is a signal for selecting an operation with four gradations or an operation with eight gradations. A Mode signal input unit of the driver IC 10 functions as a selection unit (switching means) for selecting a mode from a plurality of modes (for switching the number of gradations). Also, the four gradation mode is a typical example of the first mode according to the present embodiment and the eight gradation mode is a typical example of the second mode according to the present embodiment.

The switching control signal generation unit 20 includes at least eight signal input units of signals MN0 through MN7, a Mode signal input unit, and selectors 21 through 28. Regarding the Mode signal, a signal of H or L may be transmitted from the control signal transfer unit 520, or it may be H if it is connected to the power supply level of the driver IC 10 and it may be L if it is grounded. For example, it is possible to select the four gradations or the eight gradations by designing the driver IC 10 in such a way that it operates for four gradations when the Mode signal is H and it operates for eight gradations when the Mode signal is L.

The signal MN0 is sent to a terminal of the selector 21 which is enabled when Mode=L, a terminal of the selector 21 which is enabled when Mode=H, and a terminal of the selector 25 which is enabled when Mode=H. Also, an output of the selector 21 is the switching control signal MI0 and an output of the selector 25 is the switching control signal MI4.

The signal MN1 is sent to a terminal of the selector 22 which is enabled when Mode=L, a terminal of the selector 22 which is enabled when Mode=H, and a terminal of the selector 26 which is enabled when Mode=H. Also, an output of the selector 22 is the switching control signal MI1 and an output of the selector 26 is the switching control signal MI5.

The signal MN2 is sent to a terminal of the selector 23 which is enabled when Mode=L, a terminal of the selector 23 which is enabled when Mode=H, and a terminal of the selector 27 which is enabled when Mode=H. Also, an output of the selector 23 is the switching control signal MI2 and an output of the selector 27 is the switching control signal MI6.

The signal MN3 is sent to a terminal of the selector 24 which is enabled when Mode=L, a terminal of the selector 24 which is enabled when Mode=H, and a terminal of the selector 28 which is enabled when Mode=H. Also, an output of the selector 24 is the switching control signal MI3 and an output of the selector 28 is the switching control signal MI7.

The signal MN4 is sent to a terminal of the selector 25 which is enabled when Mode=L. The signal MN5 is sent to a terminal of the selector 26 which is enabled when Mode=L. The signal MN6 is sent to a terminal of the selector 27 which is enabled when Mode=L. The signal MN7 is sent to a terminal of the selector 28 which is enabled when Mode=L.

By configuring the signals MN0 through MN7, the selectors 21 through 28 and the switching control signals MI0 through MI7 as described above, the signals are associated as shown in Table 1 depending on L/H of the Mode signal.

In this way, the selectors 21 through 28 switch the wiring in such a way that when the four gradation mode is selected, the same switching control signals as the switching control signals which are provided to the mask pattern setting units required (selected) for both modes (MI0 through MI3) are provided to the mask pattern setting units not required (not selected) for the four gradation mode.

TABLE 1

| | Mode = L | Mode = H |
|---|---|---|
| MI0 | MN0 | MN0 |
| MI1 | MN1 | MN1 |
| MI2 | MN2 | MN2 |
| MI3 | MN3 | MN3 |
| MI4 | MN4 | MN0 |
| MI5 | MN5 | MN1 |
| MI6 | MN6 | MN2 |
| MI7 | MN7 | MN3 |

In other words, when Mode=L, MN0 results in MI0, MN1 results in MI1, MN2 results in MI2, MN3 results in MI3, MN4 results in MI4, MN5 results in MI5, MN6 results in MI6, MN7 results in MI7, and a print job with eight gradations is available.

On the other hand, when Mode=H, MN0 results in MI0, MN1 results in MI1, MN2 results in MI2, MN3 results in MI3, MN0 results in MI4, MN1 results in MI5, MN2 results in MI6, MN3 results in MI17, and a print job with four gradations is available. In this case, if only MN0 through MN3 are input to the driver IC 10, then it is not necessary to input MN4 through MN7. Therefore, it is possible to lower the cost.

Also, by causing MN0 through MN7 to be L when Mode=L and by causing MN0 through MN3 to be L when Mode=H, all of the analog switch elements 170 of the analog switch 17 are ON regardless of analog switch selection data stored in the shift registers.

Also, by causing MN0 through MN7 to be H when Mode=L and by causing MN0 through MN3 to be H when Mode=H, all of the analog switch elements 170 of the analog switch 17 are OFF regardless of analog switch selection data stored in the shift registers.

In this way, regardless the values of the shift registers, the analog switch elements 170 of the analog switch 17 can be controlled to be all ON or all OFF by controlling MN0 through MN7 when Mode=L (eight gradations) and by controlling MN0 through MN3 when Mode=H (four gradations).

Now, in an apparatus in which an electro-mechanical conversion element, especially a piezoelectric element, is used as an actuator, there is a case where the voltage of the electro-mechanical conversion element is increased to a certain voltage before applying a drive voltage wave form to the electro-mechanical conversion element. For example, in an inkjet head, because a drive voltage wave form of a piezoelectric element starts from a certain voltage which is not zero, when the drive voltage wave form is applied suddenly in a state where the piezoelectric element is discharged, it is charged rapidly to a certain voltage and a liquid droplet may be unintentionally ejected. Therefore, there is a case where an operation is performed in which all piezoelectric elements which will be used are gradually charged to a certain voltage in advance. This operation can be achieved by the following.

In other words, by setting MI0 through MI7 to L and gradually increasing the drive voltage wave form Vcom to a certain voltage, in the case where the drive target device is a piezoelectric element (electrostrictive element), it is possible to charge to a certain voltage without unintentionally ejecting a liquid droplet. Also, by setting MI0 through MI7 to L and gradually increasing the drive voltage wave form Vcom to a certain voltage, in the case where the drive target device is a heater (electric heating element), it is possible to perform a preliminary heating.

Figure 5:
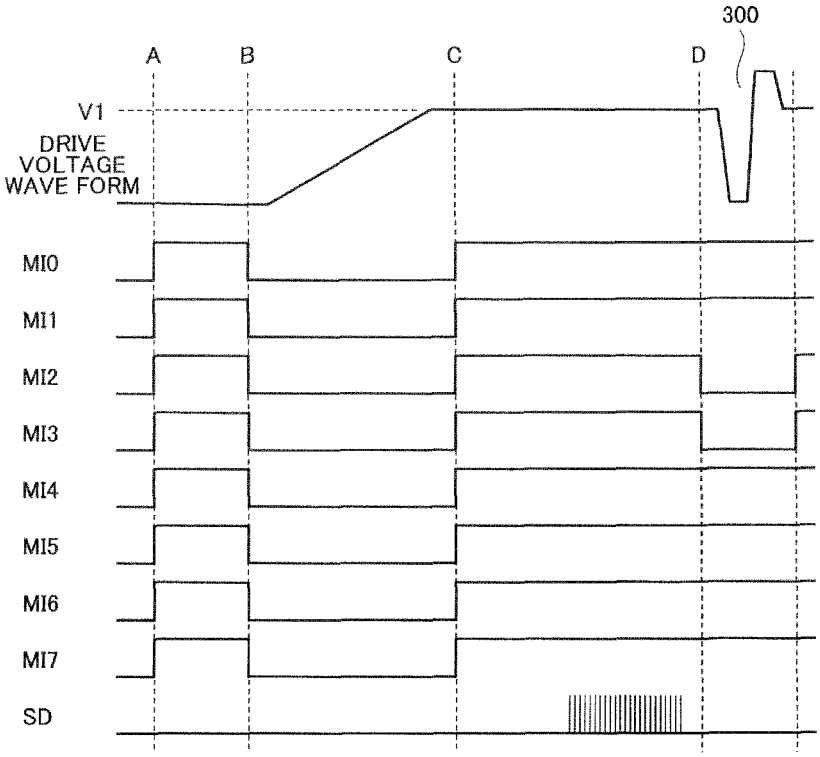
FIG. 5 is a drawing illustrating a drive voltage wave form which is caused to gradually increase to a certain voltage.

This will be described in detail referring to FIG. 5. FIG. 5 is a drawing illustrating a drive voltage waveform which is caused to gradually increase to a certain voltage. As shown in FIG. 5, the switching control signals MI0 through MI7 are all set to L (LOW) level during the time between the timing B and the timing C which is after the power ON timing A and before the timing D at which a drive voltage wave form for ejecting a liquid droplet is applied.

Also, during the time between the timing B and the timing C, the electro-mechanical conversion element is driven to a certain level of voltage V1 by increasing the drive voltage wave form gradually at a speed at which liquid droplets will not be ejected (e.g., 5.4V/μs or slower). The voltage V1 coincides with applying voltage at the beginning of the drive voltage wave form 300 for ejecting liquid droplets.

Also, the data SD for the analog switch selection may be transferred any time before the timing D at which the drive voltage wave form 300 for ejecting liquid droplets is applied.

In other words, after the power ON, before starting the control of ejecting liquid droplets, signals used for selecting the electro-mechanical conversion elements for applying the drive voltage wave form are not transmitted to the driver IC 10. Regarding all of the functionally effective switching control signals of the driver IC 10, signals are transmitted which causes the analog switch elements 170 of the driver IC 10 to be all ON. Also, at the same time, by applying a drive voltage which gradually increases to a certain voltage, the electro-mechanical conversion elements for all nozzles to be used for ejection are controlled to be distorted to a specific level.

In this way, because the analog switch 17 is maintained ON during the time between the timing B and the timing C, it is not necessary to transfer the data SD during the time between the timing A and the timing B so that the control is simplified and the controlling time is shortened.

Furthermore, because the selectors 21 through 28 switch the wiring just by switching L/H of the Mode signal, it is advantageous that an initial operation, which is needed for forcibly setting H or L to the unused shift registers storing data for analog switch selection, is not necessary. In other words, according to the present embodiment, when a lower number of gradation mode (e.g., four gradation mode) is selected, the wiring of the selectors 21 through 28 is switched in such a way that the switching control signals, which are the same as the switching control signals provided to the mask pattern setting unit which are necessary (selected) for both the lower number gradation mode and the higher number gradation mode, are provided to the mask pattern setting unit which is not necessary (not selected) for the lower number gradation mode. With this configuration, a driver IC which does not require the initial operation can be realized.

Furthermore, according to the present embodiment, in the four gradation mode, because MN4 through MN7 are only connected to input units of the selectors 21 through 28 in the driver IC 10 and are not output from the selectors 21 through 28, no problem occurs regardless of the signal levels.

Therefore, in the present embodiment, when the four gradations is selected, the MN4 through MN7, which are input terminals of control signals connected to the mask pattern setting unit which is not necessary (not selected) for the four gradations, may be fixed to be H (HIGH) level or L (LOW) level, or the signals themselves may not be provided. In other words, regarding the input terminals to which the input signal for generating the switching control signal is input only in the eight gradation mode, in the four gradation mode, the signal level may be fixed to H (HIGH) level or L (LOW) level, or the signals themselves may not be provided. With this configuration, it is possible to lower the cost because there is no need for transmitting signals from the control signal transfer unit 520.

Figures 6A, 6B:
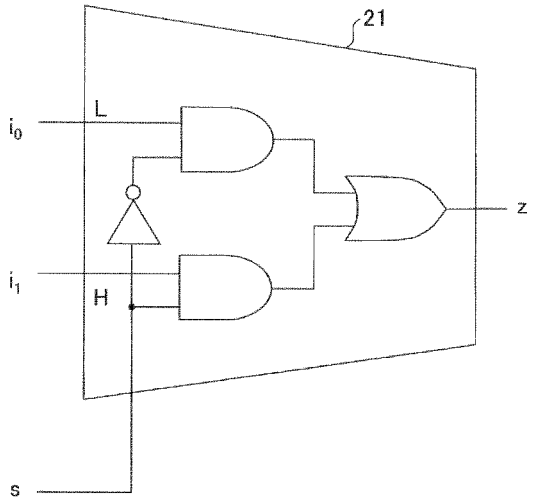
FIGS. 6A and 6B are drawings illustrating a specific example of a selector shown in FIG. 4.

FIGS. 6A and 6B are drawings illustrating a specific example of a selector shown in FIG. 4. A logic circuit shown in FIG. 6A, as understood from a truth table shown in FIG. 6B, performs an operation in which z=i0 when s-L, and z=i1 when s-H. By using the circuit shown in FIGS. 6A and 6B, selectors 21 through 28 and selectors 31 through 38 shown in FIG. 7 which will be described later can be realized.

The Second Embodiment

In the second embodiment, an example is shown in which the switching control signals MI0 through MI7 are generated by a method different from the first embodiment. It should be noted that in the second embodiment, configuration units which are the same as the embodiment which has already been described will be omitted.

Figure 7:
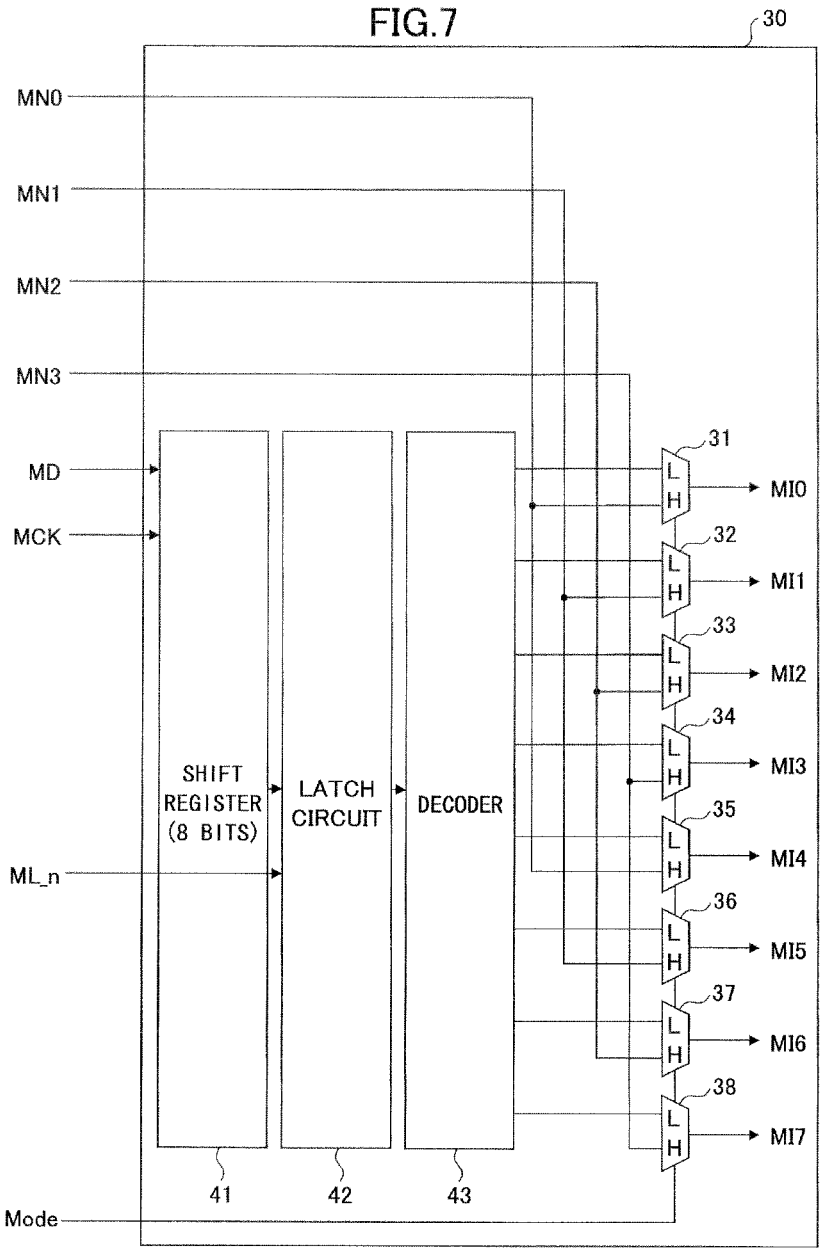
FIG. 7 is a drawing illustrating an example of a switching control signal generation unit according to the second embodiment.

FIG. 7 is a drawing illustrating an example of a switching control signal generation unit according to the second embodiment. Referring to FIG. 7, a switching control signal generation unit 30 includes a function of generating the switching control signals MI0 through MI7, which have been described referring to FIG. 1 through FIG. 3, based on signals MN0 through MN3 input from the outside, a signal MD, a signal ML_n, a signal MCK, and a signal Mode. The switching control signal generation unit 30 can be built in the driver IC 10.

The switching control signal generation unit 30 includes at least a signal input unit of the four signals MN0 through MN3, an input unit of mask pattern transfer data MD, an input unit of a mask pattern transfer clock MCK for setting the mask pattern transfer data MD in the shift registers, an input unit of a mask pattern transfer data latch ML_n for latching the values set in the shift registers, and an input unit of the Mode signal for selecting the four gradations/eight gradations.

The signal MN0 is sent to a terminal of the selector 31 which is enabled when Mode=H, and a terminal of the selector 35 which is enabled when Mode=H. Also, an output of the selector 31 is the switching control signal MI0 and an output of the selector 35 is the switching control signal MI4.

The signal MN1 is sent to a terminal of the selector 32 which is enabled when Mode=H, and a terminal of the selector 36 which is enabled when Mode=H. Also, an output of the selector 32 is the switching control signal MI1 and an output of the selector 36 is the switching control signal MI5.

The signal MN2 is sent to a terminal of the selector 33 which is enabled when Mode=H, and a terminal of the selector 37 which is enabled when Mode=H. Also, an output of the selector 33 is the switching control signal MI2 and an output of the selector 37 is the switching control signal MI6.

The signal MN3 is sent to a terminal of the selector 34 which is enabled when Mode=H, and a terminal of the selector 38 which is enabled when Mode=H. Also, an output of the selector 34 is the switching control signal MI3 and an output of the selector 38 is the switching control signal MI7.

A decoder 43 is configured to output eight switching control signals which take a value of L for setting ON the analog switch 17 or H for setting OFF the analog switch 17. The eight switching control signals output from the decoder 43 are respectively sent to the terminals of the selectors 31 through 38 which are enabled when Mode=L.

By configuring the signals MN0 through MN3, MD, ML_n, MCK, and eight switching control signals output from the decoder 43 as described above, depending on L or H of the Mode signal, the signals are associated as shown in Table. 2.

TABLE 2

| | Mode = L | Mode = H |
|---|---|---|
| MI0 | OUTPUT OF | MN0 |
| MI1 | DECODER | MN1 |
| MI2 | 43 | MN2 |
| MI3 | | MN3 |
| MI4 | | MN0 |
| MI5 | | MN1 |
| MI6 | | MN2 |
| MI7 | | MN3 |

In other words, when Mode=L, the eight kinds of switching control signals, which are outputs of the decoder 43, are connected to MI0 through MI7 so that a print job with eight gradations is possible.

Specifically, the switching control signal generation unit 30 operates as follows in the case where it is used in the eight gradation mode (a print job with any number of gradations is possible as long as the number of gradations is equal or less than eight). First, values of H or L of the mask pattern transfer data MD are respectively set in the shift registers 41 at the timing of rising pulse of the mask pattern transfer clock MCK which is transmitted to the shift registers 41 from the control signal transfer unit 520.

Then, the values set in the shift registers 41 are latched by the rising pulse of the mask pattern transfer data latch ML_n which is transmitted to the latch circuit 42 from the control signal transfer unit 520. Subsequently, the latched values are input to the decoder 43, decoded (a serial signal is converted to a parallel signal) to eight signals, which are, for example, L in case of causing the analog switch to be ON and are H in case of causing the analog switch to be OFF, and output from the decoder 43.

Because the eight switching control signals output from the decoder 43 are respectively connected to the terminals of the selectors 31 through 38, which terminals are enabled when Mode=L, the eight switching control signals are output as MI0 through MI7 from the selectors 31 through 38 and a print job with eight gradations is possible.

On the other hand, when Mode=H, MN0 results in MI0, MN1 results in MI1, MN2 results in MI2, MN3 results in MI3, MN0 results in MI4, MN1 results in MI5, MN2 results in MI6, MN3 results in MI7, and a print job with four gradations is possible. In this case, because it is not necessary for MN4 through MN7 to be input as long as the drivers MN0 through MN3 are input, it is possible to reduce the cost.

In this way, in the case where the switching control signal generation unit 30 according to the second embodiment is built in the driver IC 10, the following effect which is the same as the first embodiment is obtained. That is, the wiring is switched in such a way that when the lower number gradation mode (e.g., four gradation mode) is selected, the same switching control signals as the switching control signals which are provided to the mask pattern setting units required (selected) for both modes (MI0 through MI3) are provided to the mask pattern setting units not required (not selected) for the lower number gradation mode. With this configuration, the driver IC which does not require an initial operation can be realized.

Furthermore, the following effect which is different from the first embodiment is obtained. That is, because the switching control signals are transferred as serial data during the eight gradation mode, even in the case where the number of gradations is increased to more than eight, there is an advantage in that the control is achieved by three signals of MCK, MD and ML_n and miniaturization and cost reduction can be achieved.

The Third Embodiment

In the third embodiment, an example is shown in which input units for signals, which are not enabled in the four gradation mode and are enabled in the eight gradation mode, and input units for signals, which are enabled in the four gradation mode and are not enabled in the eight gradation mode, are assigned to common input terminals of the driver IC so that the number of terminals of the driver IC is reduced. It should be noted that, in the third embodiment, the description for the same configuration units as already described in embodiments is omitted.

Figure 8:
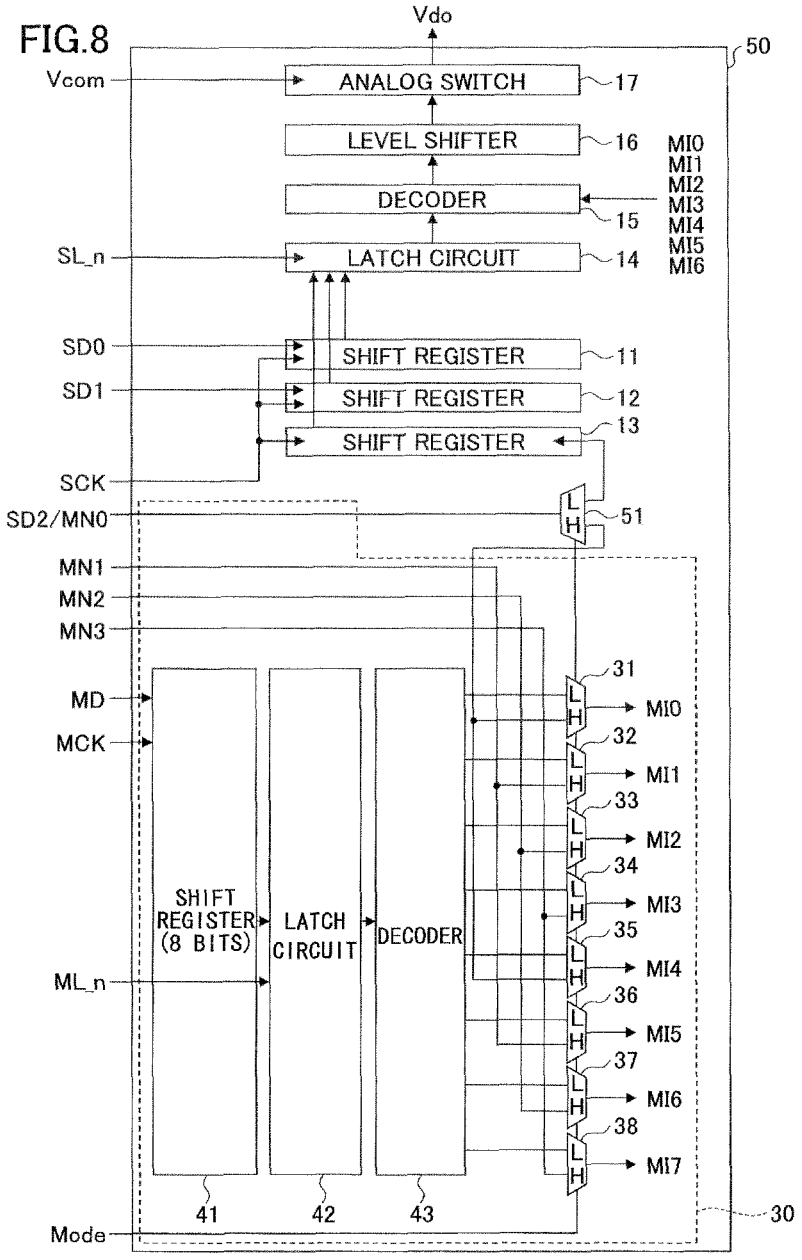
FIG. 8 is a drawing illustrating an example of a driver IC according to the third embodiment.

FIG. 8 is a drawing illustrating an example of the driver IC according to the third embodiment. Referring to FIG. 8, a driver IC 50 includes a built-in switching control signal generation unit 30 which is described referring to FIG. 7 and further includes a selector 51. Also, in the driver IC 50, SD2, which is used in the eight gradation mode and not used in the four gradation mode, and the input terminal MN0, which is used in the four gradation mode and not used in the eight gradation mode, are the same (hereinafter, the signal name is referred to as SD2/MN0).

SD2/MN0 is input to the selector 51 in the inside of the driver IC 50. In the selector 51, an output which is enabled when Mode=L (in the eight gradation mode) is connected to the shift register 13. Also, in the selector 51, an output which is enabled when Mode=H (in the four gradation mode) is connected to terminals of the selectors 31 and 35 which are enabled when Mode=H (in the four gradation mode).

By including the selector 51 in the driver IC 50 and connecting the terminals as described above, when L or H of the Mode is selected, the connection destination of the input terminal (SD2/MN0) corresponding to the selected mode is automatically selected.

In this way, a signal used only in the four gradation mode and a signal used only in the eight gradation mode are assigned to the common input terminal, and when the mode is switched to the four gradation mode or the eight gradation mode, the connection destination of the common input terminal is automatically selected in accordance with the switched mode. With this configuration, the driver IC 50 according to the third embodiment includes, in addition to the effect included in the driver IC according to the second embodiment, the further effect as described below. That is, because the number of terminals included in the driver IC 50 can be reduced, a small-sized and low-cost driver IC can be realized. It should be noted that it is feasible to provide a common input terminal not limited to be for SD2/MN0 but for any two signal lines which have an exclusive relation.

Figures 9A, 9B:
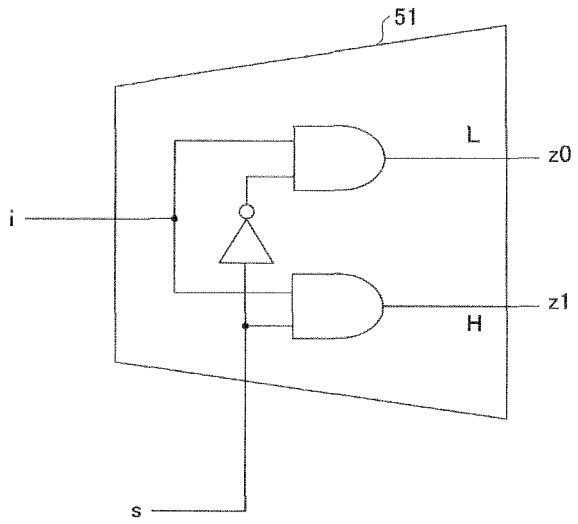
FIGS. 9A and 9B are drawings illustrating a specific example of a selector shown in FIG. 8.

FIGS. 9A and 9B are drawings illustrating a specific example of a selector shown in FIG. 8. A logic circuit shown in FIG. 9A performs, as understood from a truth table shown in FIG. 9B, an operation in which an input i is output to z0 and z1 is L regardless of a signal of the input i when Mode signal s is L, and the input i is output to z1 and z0 is L regardless of a signal of the input i when Mode signal s is H. By using the circuit shown in FIGS. 9A and 9B, the selector 51 shown in FIG. 8 can be realized.

It should be noted that the selectors 21 through 28 shown in FIG. 4 and the selectors 31 through 38 shown in FIG. 7 are selectors with two inputs and one output (multiplexers), and the selector 51 shown in FIG. 8 is a selector with one input and two outputs (demultiplexer).

The Fourth Embodiment

In the fourth embodiment, an example of an inkjet head in which the driver IC 50 according to the third embodiment is built is shown. It should be noted that in the fourth embodiment, descriptions for the same configuration units as the embodiments already described are omitted.

Figure 10:
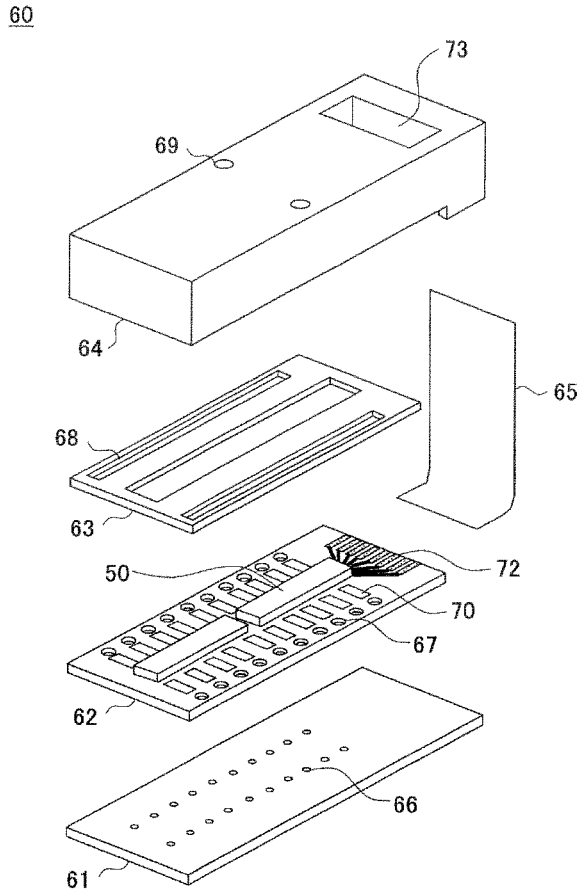
FIG. 10 is a drawing illustrating an example of an inkjet head according to the fourth embodiment.

FIG. 10 is a drawing illustrating an example of an inkjet head 60 according to the fourth embodiment. Referring to FIG. 10, in the inkjet head 60, multiple nozzle holes 66 for ejecting liquid droplets are formed in a plate-like member 61. In a plate-like member 62, individual pressure rooms (not shown) partitioned for respective nozzle holes 66 are formed on the underside. The individual pressure rooms communicate with individual ink supply ports 67. It should be noted that the inkjet head 60 is a typical example of a liquid droplet ejection head according to the present embodiment.

In a plate-like member 63, common ink flow paths 68 which lead ink to the individual ink supply ports 67 are formed. In a frame member 64, ink supply ports 69 which supply ink from an ink tank (not shown) to the common ink flow paths 68 are formed. By laminating the plate-like members 61 through 63 and connecting them to the frame member 64, flow paths for ink from the ink supply port 69 to the nozzle holes 66 are formed.

Furthermore, in the plate-like member 62, using a method of printing, applying, film-making, pasting or the like, electro-mechanical conversion elements 70, which are configured with a thin Piezoelectric body, a resistive element, or the like, are provided corresponding to individual pressure rooms. Also, for example, the driver IC 50 is implemented which selectively applies a drive voltage to the electro-mechanical conversion elements 70 according to print data sent from the control signal transfer unit 520 shown in FIG. 1. Positive electrodes disposed on the top parts of the electro-mechanical conversion elements 70 are connected to an output (drive voltage output) Vdo of the analog switch 17 disposed in the driver IC 50.

There are wirings from the driver IC 50's drive power supply input, I/O, power supply or the like to connection terminals 72. The connection terminals 72 are electrically connected to a wiring member 65 which is an FPC (Flexible printed circuit), FFC (Flexible flat cable), or the like. The wiring member 65 is, for example, connected to the drive voltage source 270, the power supply 280, the control signal transfer unit 520, or the like shown in FIG. 1.

There are wirings from the negative electrodes disposed on the bottom parts of the electro-mechanical conversion elements 70 to the connection terminals 72. The connection terminals 72 are electrically connected to the wiring member 65 which is an FPC, FFC, or the like, and are connected to the second drive voltage source 272, the ground of the circuit, or the like shown in FIG. 2. The wiring member 65 is internally encapsulated in the frame member 64 and pulled out from a pull-out opening 73 to the outside of the inkjet head 60. The connection terminals 72 are, for example, flatly disposed at the end part of the plate-like member 62.

A drive voltage is supplied from the wiring member 65 to the driver IC 50, and the drive voltage is supplied to the electro-mechanical conversion elements 70 selected by the driver IC 50. With this configuration, the electro-mechanical conversion elements 70 generate the volume changes of the individual pressure rooms in accordance with the voltage differences between the voltages applied to the positive electrodes and the voltages applied to the negative electrodes and when the volumes of the individual pressure rooms are rapidly decreased, ink is pushed out from the nozzle holes 66 and ink droplets (liquid droplets) are ejected.

In this way, in the fourth embodiment, the driver IC 50 according to the third embodiment is used for the drive control of the electro-mechanical conversion elements 70 in the inkjet head 60. With this configuration, without increasing the kinds of the driver ICs 50, and further without increasing the kinds of the heads, an inkjet head which performs the control of fewer gradations and an inkjet head which performs the control of more gradations can be realized and an effect of cost reduction can be obtained.

It should be noted that the inkjet head which performs the control of fewer gradations is, for example, an inkjet head which performs the gradation control of four gradations of no droplet ejection, a small droplet, a middle droplet and a big droplet. Also, the inkjet head which performs the control of more gradations is, for example, an inkjet head which performs the gradation control of five gradations of no droplet ejection with slight drive, a small droplet, a middle droplet, a big droplet, and no droplet without slight drive.

The Fifth Embodiment

In the fifth embodiment, another example of an inkjet head in which the driver IC 50 according to the third embodiment is built is shown. It should be noted that in the fifth embodiment, descriptions for the same configuration units as in the embodiments already described are omitted.

Figure 11:
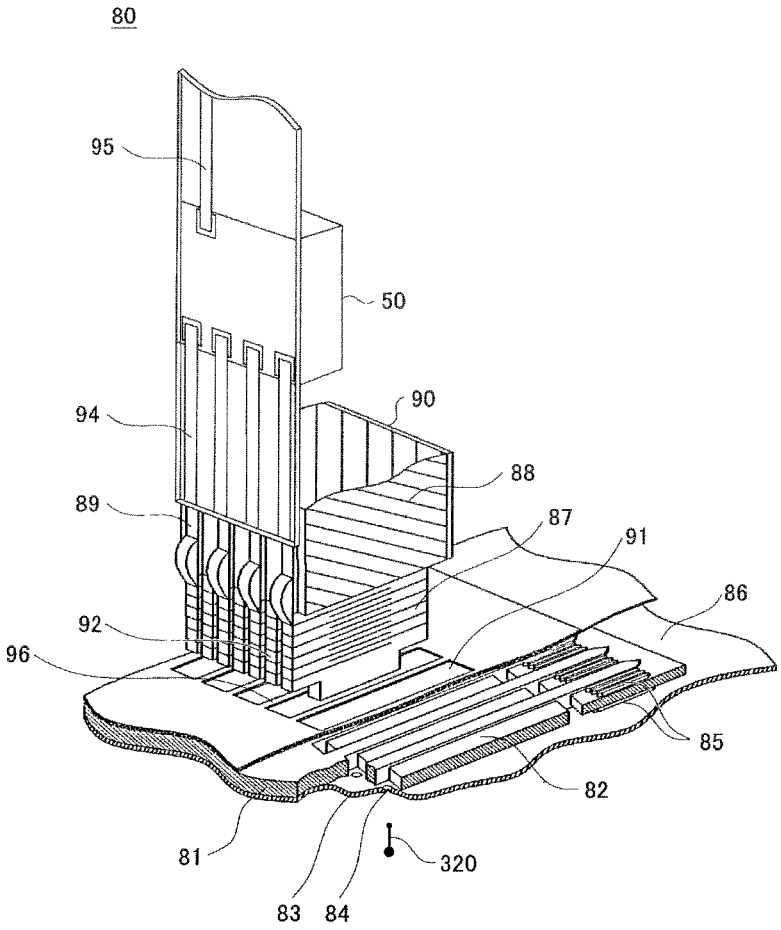
FIG. 11 is a drawing illustrating an example of an inkjet head according to the fifth embodiment.

FIG. 11 is a drawing illustrating an example of an inkjet head 80 according to the fifth embodiment. Referring to FIG. 11, in the inkjet head 80, individual pressure rooms 82 are formed in an ink flow path forming member 81 and first ends of individual pressure rooms 82 communicate with nozzle holes opened in a nozzle plate 83. The other ends of the individual pressure rooms 82, after passing restrictors 85 which are places where the ink flow paths are narrowed so that the pressure applied to the ink of the individual pressure rooms will not decrease, communicate with a common ink flow path 86. It should be noted that the inkjet head 80 is a typical example of a liquid droplet ejection head according to the present invention.

A means for generating pressure for ejecting ink is a piezoelectric element 87 of the laminated structure. The piezoelectric element 87 is fixed to a piezoelectric element supporting substrate 88 disposed in the laminating direction and generates pressure utilizing piezoelectric expansion and contraction in the d33 direction. Therefore, the piezoelectric element 87 performs an operation in which the pressure is decreased when the voltage applied to the individual electrode 89 disposed at the positive electrode of the piezoelectric element 87 is decreased and the piezoelectric element 87 is discharged, and the pressure is increased when the voltage applied to the individual electrode 89 of the piezoelectric element 87 is increased and the piezoelectric element 87 is charged.

Individual electrodes 89 of the piezoelectric elements 87 are disposed on one side of the piezoelectric element supporting substrate 88 and connected by soldering or the like to wiring 94 connected by ultrasonic welding or the like to a terminal of an output (drive voltage output) Vdo of the analog switch 17 disposed in the driver IC 50. Wiring 95 connected by ultrasonic welding or the like to a drive voltage input terminal of the driver IC 50 is, for example, connected to an output of the common drive voltage wave form generation unit 510 via the drive voltage source 270 shown in FIG. 1.

A common electrode 90 disposed at the negative electrode of the piezoelectric elements 87 is an electrode common for a negative electrode of each piezoelectric element and is disposed on the other side of the piezoelectric element supporting substrate 88, and is, for example, connected to the ground of the common drive voltage wave form generation unit 510 shown in FIG. 1. Both the piezoelectric element supporting substrate 88 and the ink flow path forming member 81 are fixed to a housing (not shown) and almost do not relatively move.

A surface of the piezoelectric element 87 which is not fixed to the piezoelectric element supporting substrate 88 is fixed to an elastic membrane 91. The elastic membrane 91 forms a part of walls of the individual pressure rooms 82, which provides a structure in which when the elastic membrane 91 is deformed by expansion and contraction of the piezoelectric element 87, the volumes of the individual pressure rooms 82 are changed.

Piezoelectric elements 92 are disposed next to the piezoelectric elements 87. A surface of the piezoelectric element 92 which is not fixed to the piezoelectric element supporting substrate 88 is fixed to partitions 96 of the individual pressure rooms 82, which helps increase the rigidity of the head. The inkjet head 80 is a head in which a plurality of the same structures as the above structure are arranged in line at 1/150 inches intervals. It should be noted that the piezoelectric elements 87 and the piezoelectric elements 92 are typical examples of the electro-mechanical conversion element according to the present invention.

Next, the ink droplet ejection principle of the inkjet head 80 will be described. The analog switch elements 170 of the analog switch 17 of the driver IC 50 are connected to the individual electrodes 89 of the corresponding piezoelectric elements. With this configuration, for example, by connecting the wiring 95 to which the drive voltage is supplied to only the individual electrodes 89 of the piezoelectric elements of the nozzle from which ink droplets should be ejected, the voltage can be applied to the individual electrodes 89 according to the data transmitted to the driver IC 50 from the control signal transfer unit 520 shown in FIG. 1. Charging and discharging of the piezoelectric elements is caused by the voltage applied to the individual electrodes 89.

Regarding the piezoelectric element of the nozzle from which ink droplets should not be ejected, by periodically applying a voltage to the individual electrodes 89 so as to prevent the piezoelectric element from naturally discharging, charging the piezoelectric element such that the length of the piezoelectric element is kept longer than the natural length in the laminating direction, the elastic membrane 91 is almost kept in a state where the individual pressure rooms 82 are pushed in by the elastic membrane 91. When the voltage applied to the individual electrode 89 is decreased, the discharging is performed and the piezoelectric element shrinks in the laminating direction. With this operation, the elastic membrane 91 is pulled to decrease the pressure of the individual pressure room 82 and ink is supplied to the individual pressure room 82 from the common ink flow path 86 through the restrictors 85.

Subsequently, when the voltage applied to the individual electrode 89 is increased, the piezoelectric element is charged, extended in the laminating direction, and pushes the elastic membrane 91 into the individual pressure room 82. With this operation, the pressure for the ink in the individual pressure room 82 is increased, the ink is pushed out from a nozzle hole 84 which communicates with the individual pressure room 82, and the ink is ejected as an ink droplet 320.

During the pressure decreasing process of the individual pressure room 82, because the surface tension acting on the nozzle hole 84 is designed to be greater than the flow resistance of the restrictor 85, the air is not drawn from the nozzle hole 84; instead, the ink is supplied to the individual pressure room 82. During the pressure increasing process of the individual pressure room 82, because the flow resistance of the restrictor 85 is designed to be greater than the surface tension acting on the nozzle hole 84, the ink does not return from the restrictor 85 to the common ink flow path 86; instead, the ink droplet is ejected from the nozzle hole 84.

In this way, in the fifth embodiment, the driver IC 50 according to the third embodiment is used for the drive control of the piezoelectric element in the inkjet head 80. With this configuration, without increasing the kinds of the driver ICs 50, and further without increasing the kinds of the heads, an inkjet head which performs the control of a lesser number of gradations and an inkjet head which performs the control of a greater number of gradations can be realized and an effect of cost reduction can be obtained.

The Sixth Embodiment

In the sixth embodiment, an example of an image forming apparatus which is equipped with the inkjet head 60 is shown. It should be noted that, in the sixth embodiment, descriptions for the same configuration units as those in the embodiments already described are omitted.

Figure 12:
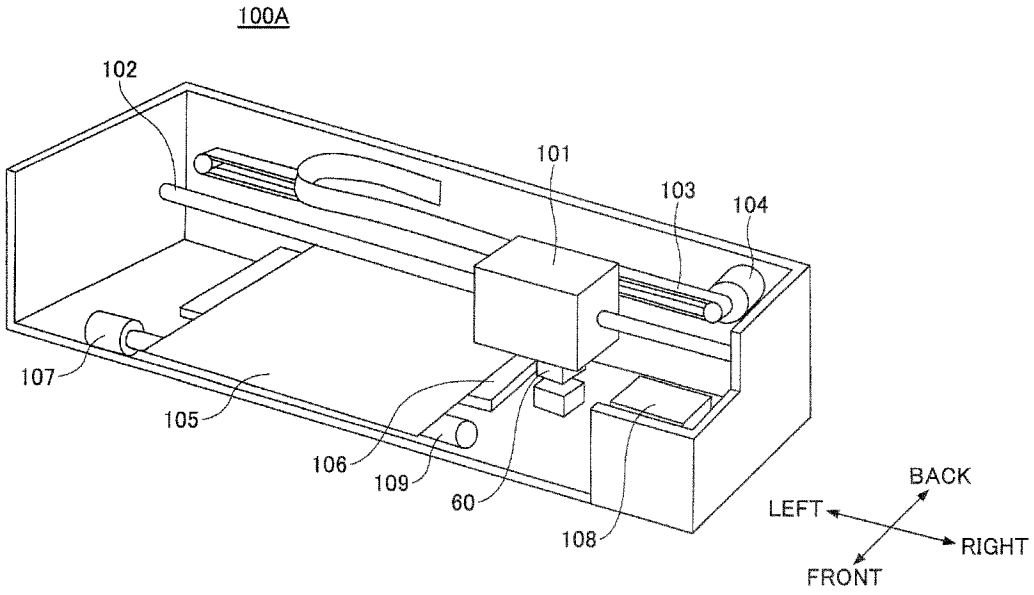
FIG. 12 is a drawing illustrating an example of an image recording apparatus according to the sixth embodiment.

FIG. 12 is a drawing illustrating an example of an image recording apparatus according to the sixth embodiment. Referring to FIG. 12, an image forming apparatus 100A according to the sixth embodiment is equipped with the inkjet head 60 (refer to FIG. 8). It should be noted that the functional configuration of the image forming apparatus 100A may be the same as the image forming apparatus 100 described in the first embodiment.

A carriage 101 is disposed inside of the image forming apparatus 100A and configured to be movable to the left and right along a guide rod 102. The carriage 101 is connected to a belt 103. The belt 103 is connected to a motor 104. The belt 103 is moved to the left and right by the rotation of the motor 104, and at the same time, the carriage 101 is moved to the left and right.

In the carriage 101, the inkjet head 60, in which many nozzles (not shown) are disposed in multiple rows, is included. The inkjet head 60 moves to the left and right in accordance with the movement of the carriage 101. With the inkjet head 60, unnecessary ejection can be prevented by a simple control and a few control signals.

Furthermore, in the image forming apparatus 100A, a platen 106, which supports a medium 105, and a paper feed roller 109 are disposed. By moving the paper feed roller 109 with a motor 107 while supporting the medium 105 with the platen 106, the medium 105 is conveyed forward.

For example, while moving the carriage 101 to the left, liquid droplets are ejected from the inkjet head 60 to the medium 105 according to the data transmitted from, for example, the control signal transfer unit 520 shown in FIG. 1. Then, for example, the medium 105 is moved forward by a predetermined distance. Then, this time, while moving the carriage 101 to the right, liquid droplets are ejected from the inkjet head 60 to the medium 105 according to the data transmitted from, for example, the control signal transfer unit 520 shown in FIG. 1. By repeating these operations, a desired image is obtained on the whole surface of the medium 105.

The carriage 101 waits on a maintenance apparatus 108 while there is no print job. It is possible for the carriage 101 to revive a nozzle which no longer ejects a liquid droplet by drawing out ink from the inkjet head 60 or to seal the nozzle by putting a cap on the inkjet head 60 in order to prevent the ink from drying and being unable to be ejected from the nozzle.

In this way, in the sixth embodiment, by having the image forming apparatus 100A equipped with the inkjet head 60 according to the fourth embodiment, it is possible to prevent undesired ejection with a simple control and a small number of control signals.

As described above, preferred embodiments have been described in detail. But the embodiments are not limited to the embodiments described above. Various modifications and replacements can be made to the above embodiments without departing from the scope set forth in the appended claims.

For example, in the above embodiments, examples are described in which the four gradations and the eight gradations can be switched, but the numbers of the gradations (numbers of mask patterns) to be switched can be any numbers for the implementation. For example, sixteen gradations is possible by causing the data signals to be four bits. In the case of a driver IC which is capable of switching the four gradations and the sixteen gradations, it is only needed that the switching control signals MI4 through MI15 which are not used when the four gradations is selected are assigned to the MI0 through MI3 which are used. It should be noted that it is possible to switch among three different gradations (e.g., four gradations, eight gradations and 16 gradations) and it is possible to switch among more than three gradations.

Also, in the above embodiments, examples are described in which data signals of as many as the number of bits of the data signals are included. However, even when the number of data signals input from the outside of the driver IC is one, by transmitting data of several bits arranged in line in one data signal, several bits of data can be transmitted. In other words, the present invention is not limited by the number of data signals or the number of the data signal input units.

Also, various methods can be considered as a transmission method of the switching control signal. As long as the present invention is applied to the end result of the switching signal of those methods used for decoding, the effects of the present invention are obtained. Therefore, the transmission method of the switching control signal is not limited to those methods described in the above embodiments.

Also, exactly the same operation and the same effects can be obtained even when the relationship of the H (HIGH) level and the L (LOW) level of the operation used in the description of the above embodiments is designed to be opposite to the description. Also, exactly the same operation and the same effects can be obtained even when the rising pulse used in the description in the above embodiments is designed to be a falling pulse.

Also, in the fourth and the fifth embodiments, the driver IC 10 may be used instead of the driver IC 50. Also, in the sixth embodiment, the inkjet head 80 may be used instead of the inkjet head 60.

The present application is based on and claims the benefit of priority of Japanese Priority Application No. 2013-189063 filed on Sep. 12, 2013 and Japanese Priority Application No. 2014-177617 filed on Sep. 2, 2014, the entire contents of which are hereby incorporated by reference.

What is claimed is:

1. A control circuit in which an analog switch is built, an ON/OFF timing of the analog switch can be controlled, a plurality of mask patterns can be set, one of the mask patterns which is used for switching ON/OFF the analog switch can be selected by analog switch selection data, and a number of the mask patterns which can be set can be selected, the control circuit comprising:

a plurality of mask pattern setting units configured to set one of the mask patterns by one of switching control signals; and a selection unit configured to select a mode from a plurality of modes including a first mode in which the number of mask patterns is smaller and a second mode in which the number of mask patterns is larger, wherein, when the first mode is selected by the selection unit, to one of the mask pattern setting units which is not selected by the analog switch selection data, the same one of the switching control signals that is supplied to another one of the mask pattern setting units which is selected by the analog switch selection data is supplied.

2. The control circuit as claimed in claim 1, wherein one of input terminals to which an input signal for creating one of the switching control signals is input in only the second mode is, in the first mode, fixed to an H (HIGH) level or an L (LOW) level, or the input signal itself is not supplied to the one of the input terminal.

3. The control circuit as claimed in claim 1, wherein a signal used only in the first mode and a signal used only in the second mode are assigned to a common input terminal; and when the mode is switched to the first mode or the second mode, the common input terminal is automatically connected to the signal used only in the first mode or the signal used only in the second mode according to the switched mode.

4. A liquid droplet ejection head comprising:

the control circuit as claimed in claim 1;

a plurality of nozzle holes configured to eject liquid droplets;

individual pressure rooms configured to communicate with the corresponding nozzle holes and are partitioned for the corresponding nozzle holes; and a plurality of ejection pressure generation units configured to be disposed corresponding to the respective individual pressure rooms, to be selectively supplied with a drive voltage by the control circuit, wherein when the drive voltage is supplied to one of the ejection pressure generation units selected by the control circuit, the liquid droplet is ejected from the corresponding one of the individual pressure rooms via the corresponding one of the nozzle holes.

5. An image forming apparatus in which the liquid droplet ejection head as claimed in claim 4 is mounted.

6. The image forming apparatus as claimed in claim 5, wherein the ejection pressure generation units are electrostrictive elements, after the power-on and before controlling the liquid droplet to be ejected, a signal for selecting one of the electrostrictive elements to which the drive voltage is supplied is not transmitted to the control circuit, and regarding all of the functionally effective switching control signals of the control circuit, signals are transmitted which causes analog switching elements to be ON, and at the same time, by applying a voltage which gradually increases to a certain voltage as the drive voltage, the electrostrictive elements of all the nozzles used for ejection are controlled to be distorted to a specific level.

7. The image forming apparatus as claimed in claim 5, wherein the ejection pressure generation units are electric heating elements, after the power-on and before controlling the liquid droplet to be ejected, a signal for selecting one of the electric heating elements to which the drive voltage is supplied is not transmitted to the control circuit, and regarding all of the functionally effective switching control signals of the control circuit, signals are transmitted which causes analog switching elements to be ON, and at the same time, by applying a voltage which gradually increases to a certain voltage as the drive voltage, the electric heating elements of all the nozzles used for ejection are controlled to be heated to a specific level.

8. A control method of a control circuit in which an analog switch is built, an ON/OFF timing of the analog switch can be controlled, a plurality of mask patterns can be set, one of the mask patterns which is used for switching ON/OFF the analog switch can be selected by analog switch selection data, and a number of the mask patterns which can be set can be selected, the control method including:

a plurality of mask pattern setting units setting one of the mask patterns by one of switching control signals; and a selection unit selecting a mode from a plurality of modes including a first mode in which the number of mask patterns is smaller and a second mode in which the number of mask patterns is larger, wherein, when the first mode is selected by the selection unit, to one of the mask pattern setting units which is not selected by the analog switch selection data, the same one of the switching control signals that is supplied to another one of the mask pattern setting units which is selected by the analog switch selection data is supplied.

* * * * *